US007819357B2

(12) United States Patent
Fox et al.

(10) Patent No.: US 7,819,357 B2
(45) Date of Patent: Oct. 26, 2010

(54) ADJUSTABLE DIAMETER TAPE ROLL CARTRIDGE CORE ASSEMBLY OF A TAPE ROLL DISPENSING CARTRIDGE ASSEMBLY

(75) Inventors: Bryce J. Fox, Honesdale, PA (US); William J. Menta, West Wyoming, PA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 12/073,145

(22) Filed: Feb. 29, 2008

(65) Prior Publication Data

US 2009/0218434 A1 Sep. 3, 2009

(51) Int. Cl.
*B65H 75/24* (2006.01)

(52) U.S. Cl. ..... 242/573.9; 242/573.1; 242/599.4; 156/577

(58) Field of Classification Search ..... 242/578, 242/578.1, 578.2, 599.4, 599, 596.7, 597.5, 242/571.8, 573, 573.1, 573.9, 597.6, 407; 156/574, 576, 577, 579
See application file for complete search history.

(56) References Cited

U.S. PATENT DOCUMENTS 1,670,886 A * 5/1928 Fellows ..... 242/573
3,135,475 A * 6/1964 Dodsworth ..... 242/356.1
3,356,310 A * 12/1967 Yokota ..... 242/571.8
3,779,476 A * 12/1973 Hofbauer ..... 242/531.1
3,980,245 A * 9/1976 Delehoy ..... 242/577
4,422,590 A * 12/1983 Rathbone ..... 242/571.8
4,428,546 A * 1/1984 Weideman ..... 242/578.1
4,534,519 A * 8/1985 Euteneuer et al. ..... 242/571.8
4,867,391 A * 9/1989 Resch ..... 242/118.5
4,880,152 A * 11/1989 Trankle ..... 224/162
5,622,333 A * 4/1997 Jacques ..... 242/578.2
5,772,151 A * 6/1998 Teng ..... 242/573
5,895,005 A * 4/1999 Simchock ..... 242/470
6,098,918 A * 8/2000 Simchock ..... 242/573.9
6,241,181 B1 * 6/2001 Campbell ..... 242/578

* cited by examiner

*Primary Examiner*—Michael R Mansen
*Assistant Examiner*—Juan J Campos
(74) *Attorney, Agent, or Firm*—Law Offices of Steven W. Weinrieb

(57) ABSTRACT

An adjustable diameter tape roll cartridge core assembly which permits various different tape rolls, manufactured, for example, by various different tape roll manufacturers, and characterized by different internal diameter dimensions, to be fixedly and securedly mounted upon the tape roll cartridge core member of a tape roll dispensing cartridge assembly of a carton or case sealing machine. The core assembly comprises an expandable and contractible annular ring member whereby the external diametrical extent of such expandable and contractible annular ring member is adjustable so as to in fact be capable of tightly engaging the inner peripheral surface portion of any one of various different tape rolls having various different internal diameter dimensions.

16 Claims, 1 Drawing Sheet

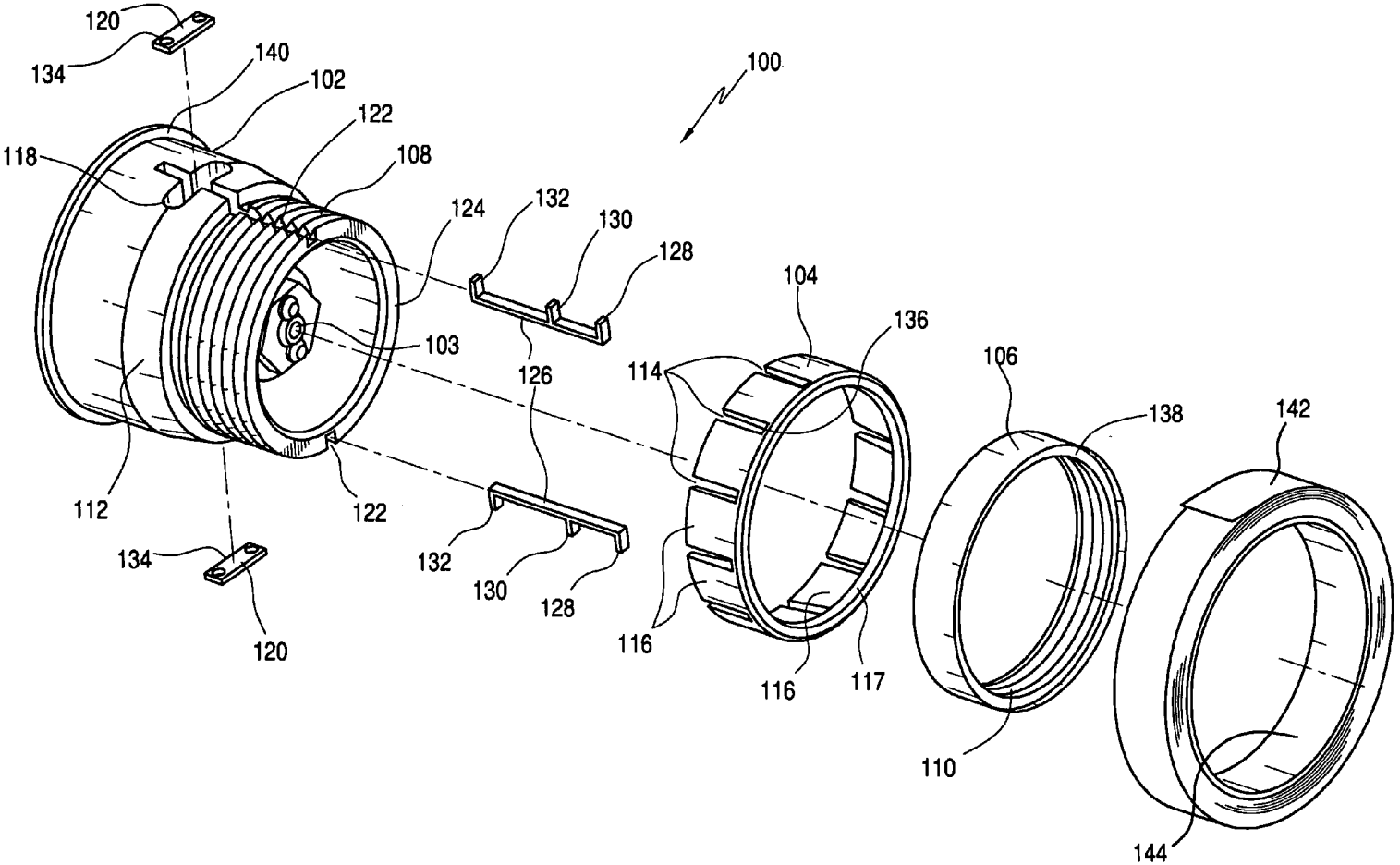
100
102
103
104
106
108
110
112
114
116
116
117
118
120
120
122
122
124
126
128
128
130
130
132
132
134
134
136
138
140
142
144

ADJUSTABLE DIAMETER TAPE ROLL CARTRIDGE CORE ASSEMBLY OF A TAPE ROLL DISPENSING CARTRIDGE ASSEMBLY

FIELD OF THE INVENTION

The present invention relates generally to carton or case sealing machines, and more particularly to a new and improved tape roll cartridge core assembly of a tape roll dispensing cartridge assembly of a carton or case sealing machine wherein the diameter of the tape roll cartridge core assembly is adjustable so as to be able to properly accommodate and mount different tape rolls manufactured and supplied by different tape roll manufacturers such that, in effect, the inner diameter of a particular tape roll will not be smaller than the outer diameter of the tape roll cartridge core assembly so as to in fact permit the tape roll to be easily mounted and subsequently secured upon the tape roll cartridge core assembly, and conversely, the inner diameter of a particular tape roll will not be larger than the outer diameter of the tape roll cartridge core assembly so as to in fact permit the tape roll to not only be easily mounted upon the tape roll cartridge core assembly, but to be subsequently fixedly secured upon the tape roll cartridge core assembly such that no relative movement will subsequently occur between the tape roll and the tape roll cartridge core assembly during, for example, tape application procedures whereby, for example, the tape roll would not be properly centered upon the tape roll cartridge assembly and would not exhibit or generate the proper amount of tension in order to achieve a proper carton or case sealing operation.

BACKGROUND OF THE INVENTION

In connection with carton or case sealing machines, sealing tape rolls are mounted upon core structures of the tape roll dispensing cartridge assemblies. Since sealing tape rolls are manufactured by a multiplicity of tape roll manufacturers, the inner diameter dimensions of the various different sealing tape rolls will vary, or more accurately, will be inconsistent, from manufacturer to manufacturer. These inconsistencies or variations in the inner diameter dimensions of the various different sealing tape rolls present operational problems when the sealing tape rolls are to be mounted upon the core structures of the tape roll dispensing cartridge assemblies. More particularly, if the inner diameter of a particular sealing tape roll is less than the outer diameter of the core structure of the tape roll dispensing cartridge assembly, then the sealing tape roll will not in fact be able to mounted upon the core structure of the tape roll dispensing cartridge assembly, or alternatively, in order to in fact forcibly mount the sealing tape roll onto the core structure of the tape roll dispensing cartridge assembly, the tape roll is often deformed, distorted, or the like. Alternatively, still further, it sometimes occurs that the sealing tape roll can only be partially mounted upon the core structure of the tape roll dispensing cartridge assembly, that is, it is not properly seated or positioned at its desired location upon the core structure of the tape roll dispensing cartridge assembly. In any one of these cases or scenarios, the sealing tape will, in effect, not track correctly upon the core structure of the tape roll dispensing cartridge assembly in, for example, the desired rotatable manner, the sealing tape will not be able to be dispensed properly in the desired linear manner from the sealing tape roll, the application of the sealing tape onto the cartons or cases will be improper or substandard, or still yet further, jamming of the sealing tape could occur.

Conversely, if the inner diameter of a particular sealing tape roll is larger than the outer diameter of the core structure of the tape roll dispensing cartridge assembly, then the sealing tape roll will not in fact be properly secured upon the core structure of the tape roll dispensing cartridge assembly whereby relative movement will occur between the tape roll and the core structure of the tape roll dispensing cartridge assembly. Therefore, again, the sealing tape will, in effect, not track correctly upon the core structure of the tape roll dispensing cartridge assembly in, for example, the desired rotatable manner, the sealing tape will, accordingly, not be able to be dispensed properly in the desired linear manner from the sealing tape roll, the proper amount of tension will not be able to be developed or generated within the tape roll, the application of the sealing tape onto the cartons or cases will be improper or sub-standard, or still yet further, jamming of the sealing tape could occur.

A need therefore exists in the art for a new and improved tape roll cartridge core structure for a tape roll dispensing cartridge assembly of a carton or case sealing machine such that regardless of the inner diameter dimensions of any sealing tape roll, the sealing tape roll will in fact be properly accommodated, seated upon, and fixedly secured upon the tape roll cartridge core structure.

SUMMARY OF THE INVENTION

The foregoing and other objectives are achieved in accordance with the teachings and principles of the present invention through the provision of a new and improved tape roll cartridge core assembly which comprises a tape roll cartridge core member, an expandable and contractible ring member, and a tape roll cartridge core nut member which is adapted to be threadedly engaged upon an externally threaded forward end portion of the tape roll cartridge core member. The tape roll cartridge core member comprises a collar member which has a frusto-conically shaped external peripheral surface portion integrally formed thereon, and the expandable and contractible ring member is adapted to be movably interposed between the collar member of the tape roll cartridge core member and the tape roll cartridge core nut member. Accordingly, as the tape roll cartridge nut member is threadedly engaged upon the externally threaded forward end portion of the tape roll cartridge core member, the expandable and contractible ring member will be forced onto the frusto-conically shaped external peripheral surface portion of the collar member of the tape roll cartridge core member thereby expanding the ring member radially outwardly so as to effectively tightly engage the inner peripheral surface portion of a sealing tape roll previously disposed upon the tape roll cartridge core member. Accordingly, the sealing tape roll will be securely affixed to or upon the tape roll cartridge core member. In addition, the radial outward expansion of the expandable ring member can be varied depending upon the extent to which the tape roll cartridge nut member is threadedly engaged upon the externally threaded forward end portion of the tape roll cartridge core member so as to effectively vary the extent to which the expandable ring member is forced into engagement with and onto the frusto-conically shaped collar member of the tape roll cartridge core member.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein:

The SOLE FIGURE. is an exploded perspective view of a new and improved adjustable diameter tape roll cartridge core assembly for a tape roll dispensing cartridge assembly as constructed in accordance with the principles and teachings of the present invention and showing the cooperative parts thereof.

DETAILED DESCRIPTION OF THE PREFERRED EMBODIMENT

Referring now to the drawings, and more particularly to the SOLE FIGURE thereof, a new and improved adjustable diameter tape roll cartridge core assembly for a tape roll dispensing cartridge assembly, as constructed in accordance with the principles and teachings of the present invention and showing the cooperative parts thereof, is disclosed and is generally indicated by the reference character 100. More particularly, the new and improved adjustable diameter tape roll cartridge core assembly 100 is seen to comprise a tape roll cartridge core member 102 which is adapted to be rotatably mounted upon an inner shaft assembly 103, an expandable and contractible annular ring member 104, and a tape roll cartridge core nut member 106. The forward end portion of the tape roll cartridge core member 102 is externally threaded as at 108, and the tape roll cartridge core nut member 106 is internally threaded, as at 110, such that the tape roll cartridge core nut member 106 can be threadedly engaged upon the externally threaded portion 108 of the tape roll cartridge core member 102. The external surface portion of the tape roll cartridge core member 102 is further provided with an annular collar portion 112 at a substantially axially central portion thereof, and it is to be appreciated that the annular collar portion 112 has a substantially frusto-conically shaped configuration with the smaller diameter portion thereof being disposed adjacent to the externally threaded portion 108 of the tape roll cartridge core member 102, while the larger diameter portion thereof being disposed more remote from the externally threaded portion 108 of the tape roll cartridge core member 102. In addition, it is to be further appreciated that the expandable and contractible annular ring member 104 is fabricated from a suitable metal or plastic material which exhibits a sufficient amount of resilience, and that, in particular, the expandable and contractible annular ring member 104 is provided with a plurality of axially oriented, circumferentially spaced slits 114 such that the expandable and contractible annular ring member 104 effectively comprises a plurality of flexible and resilient, circumferentially spaced sections or fingers 116 which are only integrally connected together at the forwardmost annular end portion 117 of the expandable and contractible annular ring member 104. Accordingly, as a result of such structure, each one of the flexible and resilient, circumferentially spaced sections or fingers 116 is effectively movable either in a radially outwardly or radially inwardly manner with respect to its adjacent or neighboring sections or fingers 116, and it is also noted that each one of the flexible and resilient, circumferentially spaced sections or fingers 116 of the expandable and contractible annular ring member 104 has a substantially triangular or wedge-shaped cross-sectional configuration with the thickest portions thereof integrally connected to the forwardmost annular end portion 117 of the expandable and contractible annular ring member 104.

Continuing further, it is also seen that the tape roll cartridge core member 102 has a pair of oval-shaped recesses or bores 118 defined within diametrically opposite, or diametrically spaced, external surface regions thereof, only one which is visible, and that a pair of retaining plates 120 are adapted to be fixedly secured within the pair of diametrically opposed or diametrically spaced oval-shaped recesses or bores 118 by means of suitable fasteners, not shown. In addition, a pair of axially oriented grooves or channels 122 are also defined within diametrically opposite, or diametrically spaced, external surface regions of the tape roll cartridge core member 102 so as to extend axially rearwardly from the front annular end face 124 of the tape roll cartridge core member 102 to positions just beyond, or rearwardly of, the locations of the diametrically opposite, or diametrically spaced, oval-shaped recesses or bores 118 within which the pair of retaining plates 120 are disposed. Still further, a pair of axially oriented retaining clips 126 are adapted to be respectively disposed in a slidable manner within the axially oriented grooves or channels 122, and it is seen that each one of the pair of axially oriented retaining clips 126 comprises, in effect, three radially outwardly projecting or extending tab members 128, 130, and 132.

Accordingly, it is to be appreciated that when the pair of axially oriented retaining clips 126 are slidably disposed within the axially oriented grooves 122, and when the retaining plates 120 are fixedly mounted within the substantially oval-shaped recesses or bores 118, each one of the retaining plates 120 will be disposed atop or above a respective one of the axially oriented retaining clips 126 so as to effectively be disposed within the space defined between the radially outwardly extending or projecting tab members 130 and 132 whereby it can be appreciated that the tab members 132 are disposed respectively rearwardly of the retaining plates 120 so as to be capable of engaging the rear edge portions 134 of the retaining plates 120, as will become more fully appreciated hereinafter. Still yet further, it is also to be appreciated that when the expandable and contractible annular ring member 104 and the tape roll cartridge core nut member 106 are mounted upon the tape roll cartridge core member 102, the tab members 130 will respectively be disposed within the forwardmost end portions 136 of a pair of diametrically opposed slits 114 of the expandable and contractible annular ring member 104 while the tab members 128 will be engaged with the front annular end face 138 of the tape roll cartridge core nut member 106.

In this manner, it is to be appreciated that the expandable and contractible annular ring member 104 and the tape roll cartridge core nut member 106 are effectively connected together and will always be movable both forwardly and rearwardly in unison. It is lastly noted that the diametrical extent of the forwardmost annular end portion 117 of the expandable and contractible annular ring member 104 is substantially the same as the diametrical extent of the tape roll cartridge core nut member 106 such that the respective annular end faces of the forwardmost annular end portion 117 of the expandable and contractible annular ring member 104 and the tape roll cartridge core nut member 106 will be in surface-to-surface contact with each other whereby, as will become more fully appreciated hereinafter, the tape roll cartridge core nut member 106 will be able to effectively move the expandable and contractible annular ring member 104 in the rearward direction onto the annular collar portion 112 of the tape roll cartridge core member 102 when the tape roll cartridge core nut member 106 is threadedly engaged onto the externally threaded portion 108 of the tape roll cartridge core member 102.

Having described substantially all of the structural components comprising the new and improved adjustable diameter tape roll cartridge core assembly 100, as constructed in accordance with the principles and teachings of the present invention, the operation of the same, for effectively fixedly mounting any one of a multiplicity of tape rolls, having various different internal diameter dimensions, onto the tape roll cartridge core member 102, will now be described. More particularly, when a particular tape roll 142, disposed upon a tape roll core 144, is to initially be mounted onto the tape roll cartridge core member 102, the expandable and contractible annular ring member 104 is already disposed upon the tape roll cartridge core member 102, and in a similar manner, the tape roll cartridge core nut member 106 is likewise threadedly engaged upon the forwardmost portion of the externally threaded portion 108 of the tape roll cartridge core member 102 to a predetermined extent such that the rearwardmost edge portions of the expandable and contractible sections or fingers 116 of the expandable and contractible annular ring member 104 are just seated atop the forwardmost edge portion of the annular collar portion 112 of the tape roll cartridge core member 102. In this manner, the three components of the adjustable diameter tape roll cartridge core assembly 100, that is, the tape roll cartridge core member 102, the expandable and contractible annular ring member 104, and the tape roll cartridge core nut member 106 are effectively fixedly connected together so as to form, in effect, an integral assembly. The particular tape roll 142 is then mounted upon the entire assembly, comprising the tape roll cartridge core member 102, the expandable and contractible annular ring member 104, and the tape roll cartridge core nut member 106, until the rearwardly disposed external annular edge or face portion of the tape roll engages and is seated against an annular flange portion 140 of the tape roll cartridge core member 102.

The tape roll cartridge core nut member 106 is then rotated, for example, in the clockwise direction, as viewed in the SOLE FIGURE, so as to threadedly tighten the tape roll cartridge core nut member 106 onto the externally threaded portion 108 of the tape roll cartridge core member 102. This progressively threaded engagement of the tape roll cartridge core nut member 106 onto the externally threaded portion 108 of the tape roll cartridge core member 102 serves to effectively force the expandable and contractible annular ring member 104 to be continuously moved in the rearward direction onto the frusto-conically shaped annular collar portion 112 of the tape roll cartridge core member 102 thereby causing the flexible and resilient, circumferentially spaced sections or fingers 116 of the expandable and contractible annular ring member 104 to be expanded radially outwardly as they progressively move in the rearward direction over the external frusto-conically shaped surface of the annular collar portion 112 of the tape roll cartridge core member 102.

In this manner, the plurality of flexible and resilient, circumferentially spaced sections or fingers 116 of the expandable and contractible annular ring member 104 will be continuously expanded radially outwardly until the plurality of flexible and resilient, circumferentially spaced sections or fingers 116 of the expandable and contractible annular ring member 104 tightly engage the inner peripheral surface portion of the particular tape roll core 144 of the tape roll 142 disposed upon the tape roll cartridge core member 102, thereby effectively fixedly securing the tape roll 142 upon the tape roll cartridge core member 102. The entire tape roll cartridge core assembly 100, with the tape roll 142 fixedly secured upon the tape roll cartridge core member 102, is then able to be rotated in order to dispense the tape from the roll of tape 142 fixedly secured upon the tape roll cartridge core member 102 as a result of the latter being rotatably mounted upon the inner shaft assembly 103.

It is to be further appreciated that during this threaded movement of the tape roll cartridge core nut member 106 onto the externally threaded portion 108 of the tape roll cartridge core member 102, and the rearward movement of the expandable and contractible annular ring member 104 onto and over the external frusto-conically shaped surface of the annular collar portion 112 of the tape roll cartridge core member 102, the pair of axially oriented retaining clips 126 will simultaneously be slidably moved within the pair of axially oriented grooves 122 defined within the tape roll cartridge core member 102 whereby the rearwardmost tab members 132 will, in effect, be disengaged from the rear edge portions 134 of the retaining plates 120. However, when it is desired to, for example, remove the tape roll 142 from the tape roll cartridge core member 102, such as, for example when the tape roll 142 is depleted and needs to be replaced with a new or fresh tape roll, the tape roll cartridge core nut member 106 is rotated, for example, in the counterclockwise direction, as viewed in the SOLE FIGURE, so as to threadedly disengage the tape roll cartridge core nut member 106 from the externally threaded portion 108 of the tape roll cartridge core member 102.

As it will be recalled that the expandable and contractible annular ring member 104 is effectively integrally connected to the tape roll cartridge core nut member 106 by means of the upstanding tab members 128,130 of the axially oriented retaining clips 126 such that the expandable and contractible annular ring member 104 will be movable in the axial direction along with the tape roll cartridge core nut member 106, then the expandable and contractible annular ring member 104 will effectively be disengaged from the frusto-conically shaped surface portion of the annular collar portion 112 of the tape roll cartridge core member 102 so as to permit the plurality of flexible and resilient, circumferentially spaced sections or fingers 116 of the expandable and contractible annular ring member 104 to return to their contracted states thereby permitting the depleted tape roll to in fact be removed from the tape roll cartridge core member 102. It is also to be appreciated that at this point in time, the rearwardmost upstanding stand tab members 132 of the axially oriented retaining clips 126 will engage the rear edge portions 134 of the retaining plates 120 so as to effectively prevent the actual disengagement or separation of the tape roll cartridge core nut member 106 from the externally threaded portion 108 of the tape roll cartridge core member 102. The new and improved adjustable diameter tape roll cartridge core assembly 100, as constructed in accordance with the principles and teachings of the present invention, is therefore again ready to have a new or fresh tape roll of carton or case sealing tape fixedly mounted thereon.

Thus, it may be seen that in accordance with the principles and teachings of the present invention, there has been disclosed a new and improved adjustable diameter tape roll cartridge core assembly which permits various different tape rolls, manufactured, for example, by various different tape roll manufacturers, and characterized by different internal diameter dimensions, to be fixedly and securedly mounted upon the tape roll cartridge core member of a tape roll dispensing cartridge assembly of a carton or case sealing machine as a result of the provision of an expandable and contractible annular ring member whereby the external diametrical extent of such expandable and contractible annular ring member is adjustable so as to in fact be capable of tightly engaging the inner peripheral surface portion of any one of various different tape rolls having various different internal diameter dimensions.

Obviously, many variations and modifications of the present invention are possible in light of the above teachings.

It is therefore to be understood that within the scope of the appended claims, the present invention may be practiced otherwise than as specifically described herein.

What is claimed as new and desired to be protected by Letters Patent of the United States of America, is:

1. In combination, a roll of tape, and a tape roll core assembly for mounting the roll of tape thereon such that regardless of the internal diameter of a particular roll of tape that may be selected from a plurality of rolls of tape, said tape roll core assembly can tightly engage the particular roll of tape, comprising:

a roll of tape disposed upon a tape roll core having an internal peripheral surface which has a predetermined internal diametrical extent;

a tape roll cartridge core member defined around an axis for supporting said roll of tape thereon when said roll of tape is mounted upon said tape roll cartridge core member;

a first set of threads defined upon a first external peripheral surface portion of said tape roll cartridge core member for defining a first part of a threaded connection;

a second set of threads defined upon an internal peripheral surface portion of a nut member for threaded engagement with said first set of threads defined upon said first external peripheral surface portion of said tape roll cartridge core member so as to define a second part of said threaded connection;

an annular collar portion defined around said axis of said tape roll cartridge core member upon a second external peripheral surface portion of said tape roll cartridge core member, wherein said second external peripheral surface portion of said tape roll cartridge core member, upon which said annular collar portion is defined, is directly connected to said first external peripheral surface portion of said tape roll cartridge core member upon which said first set of threads is defined; and an annular ring member, separate from said annular collar portion of said tape roll cartridge core member and said nut member, and interposed between said annular collar portion of said tape roll cartridge core member and said nut member, so as to be movable along said annular collar portion of said tape roll cartridge core member in an axial direction, and having diametrically adjustable structure defined thereon for progressively engaging said annular collar portion of said tape roll cartridge core member as said annular ring member is moved axially along said annular collar portion of said tape roll cartridge core member in response to said second set of threads, defined upon said nut member, being progressively threadedly engaged with said first set of threads, defined upon said tape roll cartridge core member, such that said diametrically adjustable structure of said annular ring member progressively increases the external diametrical extent of said annular ring member and thereby tightly engages said internal peripheral surface of said tape roll core of said roll of tape mounted upon said tape roll cartridge core member such that regardless of the particular internal diametrical extent of a particular tape roll core of a particular roll of tape, selected from a plurality of rolls of tape having different tape roll cores having different internal diametrical extents, said particular roll of tape may be fixedly secured upon said tape roll cartridge core member.

2. The combination as set forth in claim 1, wherein:

said diametrically adjustable structure defined upon said annular ring member comprises a plurality of radially outwardly expansible and radially inwardly contractible fingers.

3. The combination as set forth in claim 2, wherein:

said annular ring member comprises a plurality of circumferentially spaced, axially oriented slits defined within said annular ring member so as to effectively define a plurality of circumferentially adjacent finger members which are independently movable with respect to each other.

4. The combination as set forth in claim 3, wherein:

said collar portion of said tape roll cartridge core member has a configuration for causing said plurality of circumferentially adjacent finger members to expand radially outwardly when said annular ring member is being mounted upon said collar portion of said tape roll cartridge core member, and for permitting said plurality of circumferentially adjacent finger members to contract radially inwardly when said annular ring member is being dismounted from said collar portion of said tape roll cartridge core member.

5. The combination as set forth in claim 4, wherein:

said annular collar portion of said tape roll cartridge core member has a substantially frusto-conically shaped cross-sectional configuration such that as said annular ring member is increasingly disposed upon said frusto-conically shaped collar portion of said tape roll cartridge core member, said plurality of circumferentially adjacent finger members will continue to expand radially outwardly in order to effectively increase the diametrical extent of said annular ring member, and as said annular ring member is increasingly removed from said frusto-conically shaped collar portion of said tape roll cartridge core member, said plurality of circumferentially adjacent finger members will continue to contract radially inwardly in order to effectively decrease the diametrical extent of said annular ring member.

6. The combination as set forth in claim 5, wherein:

each one of said finger members of said expansible and contractible annular ring member has a substantially triangular wedge-shaped cross-sectional configuration.

7. The combination as set forth in claim 6, wherein:

said substantially frusto-conically shaped cross-sectional configuration of said annular collar portion of said tape roll cartridge core member and said substantially triangular wedge-shaped cross-sectional configuration of said finger members of said expansible and contractible annular ring member are disposed opposite each other.

8. The combination as set forth in claim 3, wherein:

said first set of threads defined upon said first external peripheral surface portion of said tape core member comprises a threaded end portion of said tape roll cartridge core member; and said second set of threads defined upon said internal peripheral surface portion of said nut member are adapted to be threadedly engaged upon said externally threaded end portion of said tape roll cartridge core member.

9. The combination as set forth in claim 8, wherein:

said annular ring member, comprising said radially outwardly expansible and radially inwardly contractible fingers, is interposed between said annular collar portion of said tape roll cartridge core member and said nut member such that as said nut member is continuously threaded onto said threaded end portion of said tape roll cartridge core member, said annular ring member will be increasingly forced into engagement with said annular collar portion of said tape roll cartridge core member so as to cause said plurality of circumferentially adjacent finger members to continue to expand radially outwardly in order to effectively increase said diametrical extent of said annular ring member, and as said nut member is continuously unthreaded from said threaded end portion of said tape roll cartridge core member, said annular ring member will be decreasingly forced into engagement with said collar portion of said tape roll cartridge core member so as to permit said plurality of circumferentially adjacent finger members to continue to contract radially inwardly in order to effectively decrease said diametrical extent of said annular ring member.

10. The combination as set forth in claim 8, further comprising:

retaining clips, disposed upon said tape roll cartridge core member and engaged with said annular ring member, and said nut member, so as to prevent said annular ring member, and said nut member, from being inadvertently removed from said tape roll cartridge core member.

11. The combination as set forth in claim 10, wherein:

said retaining clips, for preventing said annular ring member, and said nut member, from being inadvertently removed from said tape roll cartridge core member, comprises a pair of retaining clips disposed upon said tape roll cartridge core member at diametrically opposite positions of said tape roll cartridge core member.

12. The combination as set forth in claim 11, further comprising:

a pair of channels are defined within said tape roll cartridge core member so as to permit said pair of retaining clips to move axially with respect to said tape roll cartridge core member.

13. The combination as set forth in claim 12, further comprising:

a pair of retaining plates fixedly mounted upon said tape roll cartridge core member.

14. The combination as set forth in claim 13, wherein:

each one of said pair of retaining clips comprises three radially outwardly projecting tab members.

15. The combination as set forth in claim 14, wherein:

a first one of said three radially outwardly projecting tab members of each one of said pair of retaining clips is adapted to engage one of said retaining plates, a second one of said three radially outwardly projecting tab members of each one of said pair of retaining clips is adapted to engage said annular ring member, and a third one of said three radially outwardly projecting tab members of each one of said pair of retaining clips is adapted to engage said nut member so as to maintain the component parts of said tape roll core assembly, comprising said tape roll cartridge core member, said annular ring member, and said nut member, together.

16. In combination, a roll of sealing tape, and a tape roll core assembly, for use within a case sealing machine, so as to mount the roll of sealing tape thereon such that regardless of the internal diameter of a particular roll of sealing tape that may be selected from a plurality of rolls of sealing tape, said tape roll core assembly can tightly engage the particular roll of sealing tape, comprising:

a roll of sealing tape disposed upon a tape roll core having an internal peripheral surface which has a predetermined internal diametrical extent;

a tape roll cartridge core member defined around an axis for supporting said roll of sealing tape thereon when said roll of sealing tape is mounted upon said tape roll cartridge core member;

a first set of threads defined upon a first external peripheral surface portion of said tape roll cartridge core member for defining a first part of a threaded connection;

a second set of threads defined upon an internal peripheral surface portion of a nut member for threaded engagement with said first set of threads defined upon said first external peripheral surface portion of said tape roll cartridge core member so as to define a second part of said threaded connection;

an annular collar portion defined around said axis of said tape roll cartridge core member upon a second external peripheral surface portion of said tape roll cartridge core member, wherein said second external peripheral surface of said tape roll cartridge core member, upon which said annular collar portion is defined, is directly connected to said first external peripheral surface portion of said tape roll cartridge core member upon which said first set of threads is defined; and an annular ring member, separate from said annular collar portion of said tape roll cartridge core member and said nut member, and interposed between said annular collar portion of said tape roll cartridge core member and said nut member, so as to be movable along said annular collar portion of said tape roll cartridge core member in an axial direction, and having diametrically adjustable structure defined thereon for progressively engaging said annular collar portion of said tape roll cartridge core member, as said annular ring member is moved axially along said annular collar portion of said tape roll cartridge core member in response to said second set of threads defined upon said nut member being progressively threadedly engaged with said first set of threads, defined upon said tape roll cartridge core member, such that said diametrically adjustable structure of said annular ring member progressively increases the external diametrical extent of said annular ring member and thereby tightly engages said internal peripheral surface of said tape roll core of said roll of sealing tape mounted upon said tape roll cartridge core member such that regardless of the particular internal diametrical extent of a particular tape roll core of a particular roll of sealing tape, selected from a plurality of rolls of sealing tape having different tape roll cores having different internal diametrical extents, said particular roll of sealing tape may be fixedly secured upon said tape roll cartridge core member.

* * * * *